US010478024B2

(12) United States Patent
Del Duke et al.

(10) Patent No.: US 10,478,024 B2
(45) Date of Patent: Nov. 19, 2019

(54) COMBINATION TOILET TRAINING SEAT AND STEP STOOL

(71) Applicant: Ginsey Industries, Inc., Swedesboro, NJ (US)

(72) Inventors: Matthew James Del Duke, Audubon, NJ (US); Christopher Ernest Greco, Sewell, NJ (US); Daniel Imberman, Philadelphia, PA (US)

(73) Assignee: GINSEY INDUSTRIES, INC., Swedesboro, NJ (US)

( * ) Notice: Subject to any disclaimer, the term of this patent is extended or adjusted under 35 U.S.C. 154(b) by 0 days.

(21) Appl. No.: 15/655,429

(22) Filed: Jul. 20, 2017

(65) Prior Publication Data

US 2019/0021560 A1 Jan. 24, 2019

(51) Int. Cl.

| | |
|---|---|
| ***A47K 11/04*** | (2006.01) |
| ***A47K 13/02*** | (2006.01) |
| ***A47K 10/38*** | (2006.01) |
| ***A47K 11/06*** | (2006.01) |
| ***A47K 13/06*** | (2006.01) |
| ***A47K 17/00*** | (2006.01) |
| ***A47K 17/02*** | (2006.01) |
| *A47K 11/10* | (2006.01) |

(52) U.S. Cl.

CPC ..... *A47K 11/04* (2013.01); *A47K 10/38* (2013.01); *A47K 11/06* (2013.01); *A47K 13/02* (2013.01); *A47K 13/06* (2013.01); *A47K 17/003* (2013.01); *A47K 17/028* (2013.01); *A47K 11/105* (2013.01)

(58) Field of Classification Search

CPC ..... A47K 11/04
USPC ..... 4/483
See application file for complete search history.

(56) References Cited

U.S. PATENT DOCUMENTS

2012/0084909 A1* 4/2012 Dunn ..... A47K 11/06 4/483

* cited by examiner

*Primary Examiner* — Lauren A Crane

(57) ABSTRACT

Embodiments of the present invention can provide a combination toilet trainer, comprising a base comprising two handles, an underside, a backside, and an open side; a removable seat comprising a backed ring and a hinged ring connected by a hinge point, each having an inner opening; and an internal bowl having an internal bowl lip; wherein the removable seat is configured to be removably mounted atop the open side of the base; and wherein the internal bowl is configured to be removably attachable to the removable seat at the inner opening by the internal bowl lip being secured between the backed ring and the hinged ring.

18 Claims, 10 Drawing Sheets

COMBINATION TOILET TRAINING SEAT AND STEP STOOL

TECHNOLOGICAL FIELD

The present invention relates generally to an apparatus for toilet training and for use as a step stool.

BACKGROUND

Toilet training is a gradual process that takes place in several steps. At first, a child may learn to emulate proper toilet technique on a trainer toilet that has a smaller body and orifice than a normal toilet, as the normal toilet may be too high for the child to reach. As the child becomes more comfortable using the toilet and grows taller, the child may begin to transition to using the adult toilet. However, the adult toilet may still be higher than the child can reach, in which case an accessible stool or other boosting device is necessary to allow the child to continue with their toilet training. Additionally, the orifice of the adult toilet may still be too large for the child to use, and thus a smaller seat may be necessary. This document describes an improved toilet training seat that may also function as a step stool.

SUMMARY

Embodiments of the present invention can provide a combination toilet trainer, comprising a base comprising two handles, an underside, a backside, and an open side; a removable seat comprising a backed ring and a hinged ring connected by a hinge point, each having an inner opening; and an internal bowl having an internal bowl lip; wherein the removable seat is configured to be removably mounted atop the open side of the base; and wherein the internal bowl is configured to be removably attachable to the removable seat at the inner opening by the internal bowl lip being secured between the backed ring and the hinged ring.

Embodiments can further provide a combination toilet trainer wherein the underside of the base further comprises one or more layers of non-slip material alternated with one or more layers of rough material; and the open side of the base further comprises a strip of non-slip material secured around a circumference of the open side.

Embodiments can further provide a combination toilet trainer wherein the base further comprises a dispenser opening located on the backside of the base; the dispenser opening further comprising one or more flexible tabs.

Embodiments can further provide a combination toilet trainer wherein the dispenser opening is configured to be closed using a dispenser cap attached to the dispenser opening through a dispenser cap connector.

Embodiments can further provide a combination toilet trainer wherein the base further comprises a dispenser configured to dispense a dispensed material from an inside of the base to an outside through the dispenser opening.

Embodiments can further provide a combination toilet trainer wherein the dispenser further comprises one or more tabbed tongs configured to secure a roll of dispensed material.

Embodiments can further provide a combination toilet trainer wherein the base further comprises a dispenser material holding area configured to hold one or more rolls of dispensed material.

Embodiments can further provide a combination toilet trainer wherein the dispenser material holding area further comprises one or more holding area tabs configured to secure the one or more rolls of dispensed material.

Embodiments can further provide a combination toilet trainer wherein the internal bowl further comprises a finger ring and a finger ring curve located on a front of the internal bowl; the hinged ring further comprising a flange located on an underside of the hinged ring; wherein the flange is configured to fit within the finger ring curve when the internal bowl is secured between the backed ring and the hinged ring.

Embodiments can further provide a combination toilet trainer wherein the internal bowl is scented.

Embodiments can further provide a combination toilet trainer wherein the removable seat further comprises one or more toilet attachment hooks located on an underside of the backed ring, the toilet attachment hooks configured to attach the removable seat to an adult toilet when detached from the base.

Embodiments can further provide a combination toilet trainer wherein the removable seat further comprises one or more strips of sealant material secured to an underside of the backed ring.

Embodiments can further provide a combination toilet further comprising a spring piece placed within the hinge point configured to provide an outward spring force against an underside of the internal bowl lip when the hinged ring is hinged open from the backed ring.

Embodiments can further provide a removable seat for use in toilet training, comprising a backed ring and a hinged ring connected by a hinge point, each having an inner opening; and an internal bowl having an internal bowl lip; wherein the internal bowl is configured to be removably attachable to the removable seat at the inner opening by the internal bowl lip being secured between the backed ring and the hinged ring.

Embodiments can further provide a removable seat wherein the removable seat further comprises one or more toilet attachment hooks located on an underside of the backed ring, the toilet attachment hooks configured to attach the removable seat to an adult toilet.

Embodiments can further provide a removable seat wherein the internal bowl further comprises a finger ring and a finger ring curve located on a front of the internal bowl; the hinged ring further comprising a flange located on an underside of the hinged ring; wherein the flange is configured to fit within the finger ring curve when the internal bowl is secured between the backed ring and the hinged ring.

Embodiments can further provide a removable seat further comprising a base comprising two handles, an underside, a backside, and an open side; wherein the removable seat is configured to be removably mounted atop the open side of the base.

Embodiments can further provide a removable seat wherein the underside of the base further comprises one or more layers of non-slip material alternated with one or more layers of rough material; and the open side of the base further comprises a strip of non-slip material secured around a circumference of the open side.

Embodiments can further provide a removable seat wherein the base further comprises a dispenser configured to dispense a dispensed material from an inside of the base to an outside through a dispenser opening.

Embodiments can further provide a method of converting a combination toilet trainer into a removable seat and a step stool, the method comprising opening a hinged ring against a backed ring; removing an internal bowl; disconnecting the backed ring from a base; rotating the base 180 degrees along a single axis; placing the base on the ground to form the step stool; placing the backed ring atop a bowl of an open adult toilet; applying downward pressure until one or more toilet attachment hooks located on the underside of the backed ring engage with the bowl of the open adult toilet; and closing the hinged ring against the backed ring to reform the removable seat.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION

Embodiments of the present invention relate to a combination toilet training seat and a step stool ("combination toilet trainer"). The combination toilet trainer can have three main components: a hollow base that, when inverted, can have sufficient strength to act as a step stool, a removable and hingeable seat that can be used either in conjunction with the base to act as a trainer toilet or can be removed and secured to an adult toilet for use as a training toilet seat, and an easily removable internal bowl that can be used as a waste repository for the child being trained. In addition, the combination toilet trainer can have the ability to dispense sanitary plastic bags to cover the bowl, and can have antiseptic and easy-clean properties.

Embodiments can provide a double injection molded, multi-functional toilet trainer which can transform from floor toilet with removable scented and antimicrobial bowl, to detachable contour toilet ring which sits securely on top of any size toilet seat (standard or elongated), to a nonslip step stool with integrated contoured handles for easy carrying, which can include a liner system. Discretely stored below the bowl within the step stool base, an integrated cartridge can hold two reserve custom scented liner rolls with an integrated dispenser for an active liner roll that can feed through a child-proof dispenser protected by a locking lid. The child-proof dispenser can allow parents to draw a new liner every time a child needs to toilet train.

The scented liner can protect the removable bowl securely by fitting in the locking channel. The removable bowl can be removed by the stay clean lift tab. The upper secondary locking ring traps the liner and bowl can secure in place to avoid disruption by the child. Once child has finished toilet training, a push button locking mechanism can release the upper secondary ring to allow access to the liner, allowing parent to remove and dispose of liner. The combination toilet training seat and step stool can be used with or without liner system.

Figure 1:
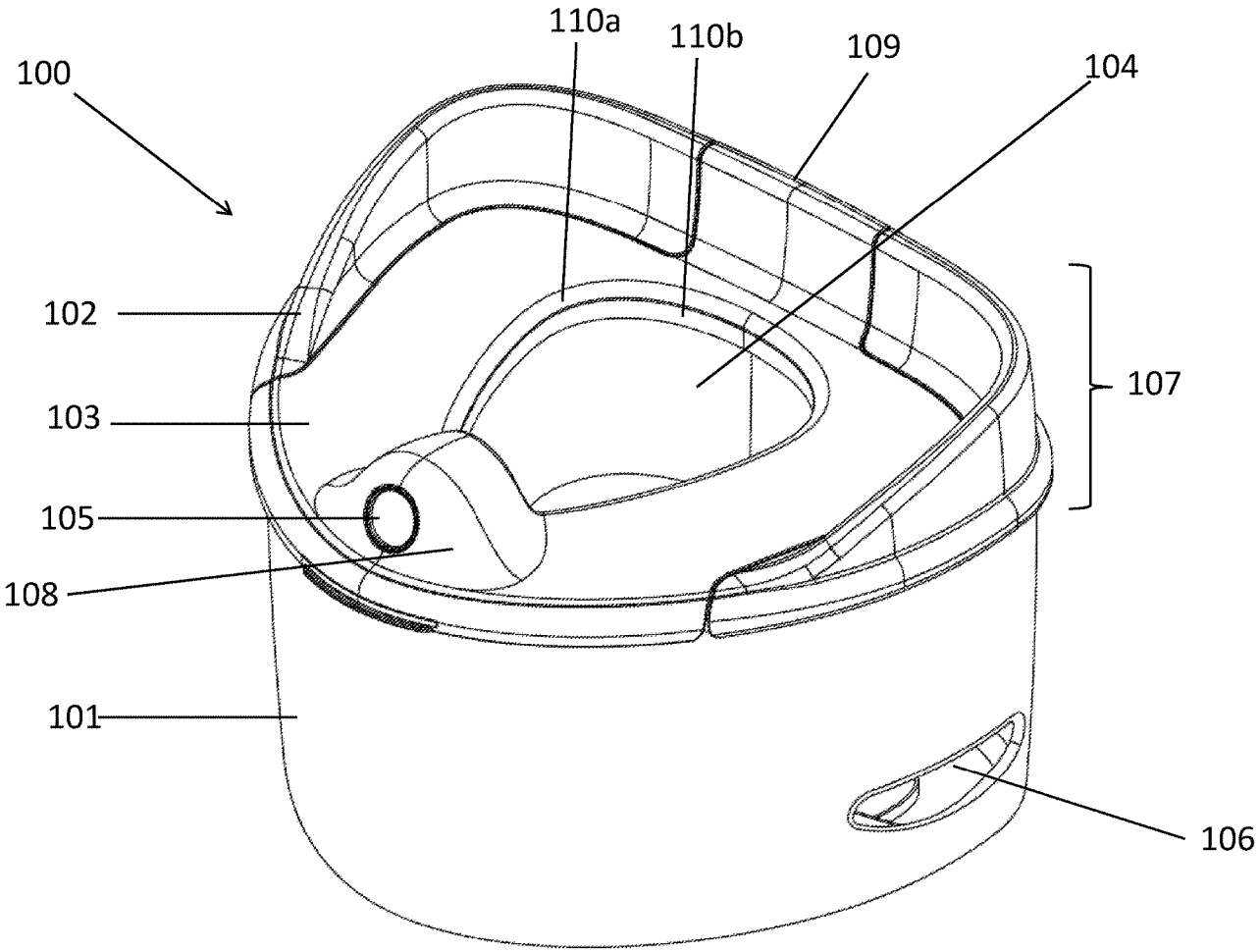
FIG. 1 illustrates a perspective view of a combination toilet training seat and step stool ("combination toilet trainer"), according to embodiments provided herein.

FIG. 1 illustrates a perspective view of a combination toilet training seat and step stool ("combination toilet trainer") 100. The combination toilet trainer 100 can comprise a base 101, a removable seat 107, and an internal bowl 104. The base 101 can have one or more handles 106, which can be reinforced openings in the base 101 with sufficient strength such that the entire combination toilet trainer 100 can be lifted and removed to a second location. The removable seat 107 can have a backed ring 102 and a hinged ring 103. The removable seat 107, including the backed ring 102 and the hinged ring 103 can have an irregular ring shape such that each of the removable seat 107 components has an inner opening 110*a*, 110*b*. The inner openings can be the same shape and size as the internal bowl 104, such that there are no gaps between the inner openings and the internal bowl 104 when the removable seat 107 and the inner bowl 104 are properly secured to the base 101. The hinged ring 103 can swivel at a hinge point 109 against the backed ring 102 such that the hinged ring 103 can be lifted to expose the internal bowl 104 for removal. The hinged ring 103 can be released through the use of a button 105 that can be disposed on a leg separator 108, and which can release a latch that secures the hinged ring 103 to the backed ring 102 such that the hinged ring 103 does not move involuntarily. The removable seat 107 can be completely detachable from the base 101. The combination toilet trainer 100 can have a contoured shape to provide legroom to the child.

Figure 2:
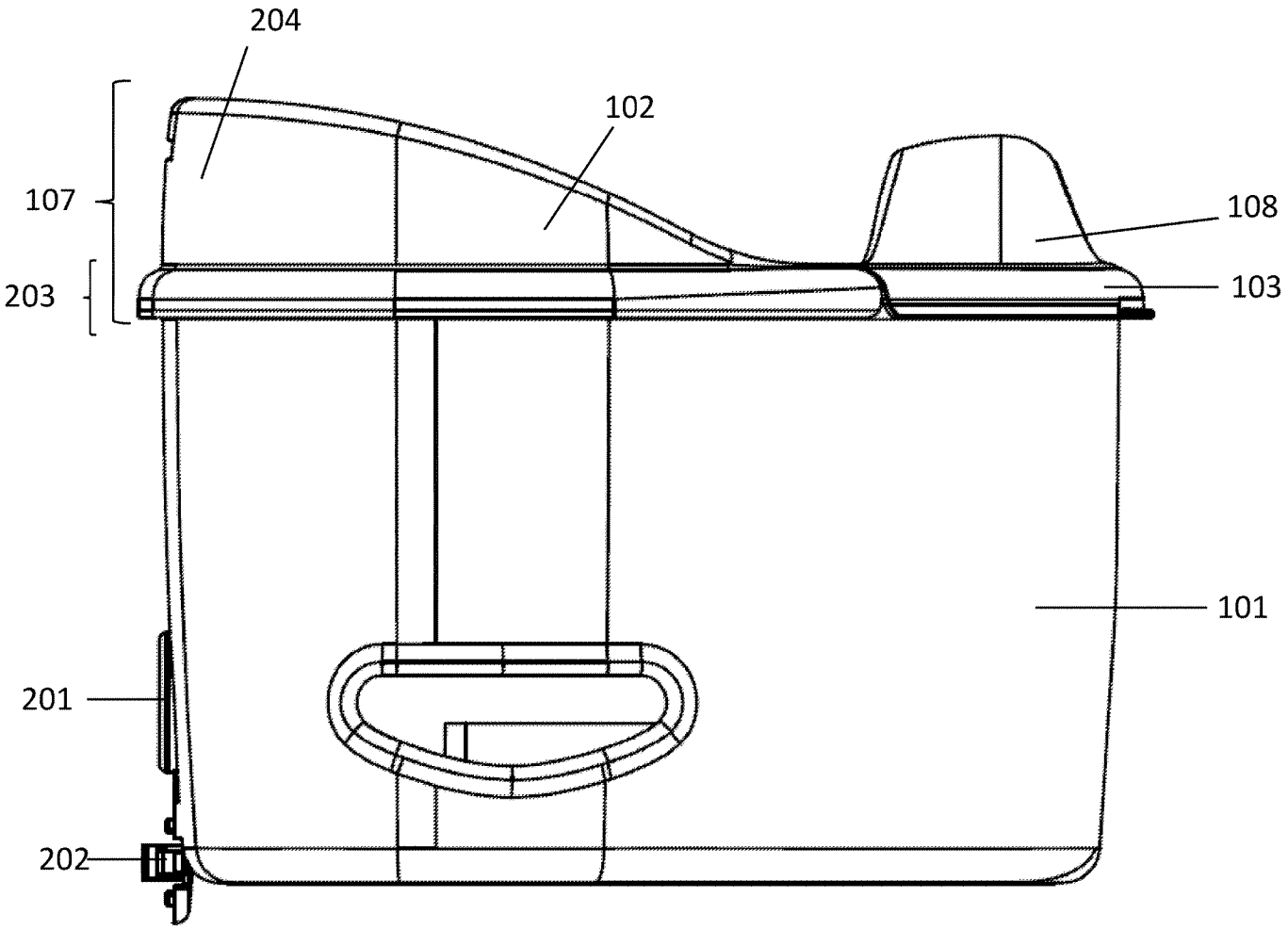
FIG. 2 illustrates a side view of the combination toilet trainer, according to embodiments provided herein.

FIG. 2 illustrates a side view of the combination toilet trainer. The removable seat 107 can sit atop the base 101 at a height such that a small child can use the combination toilet trainer 100 comfortably. The removable seat 107, including the hinged ring 103 and the backed ring 102 can have a lipped portion 203 such that the lipped portion overlaps and covers the base 101 when attached. This lipped portion 203 can have a form factor similar to the base 101 such that there is a complete overlap and the base 101 securely supports the removable seat 107 when attached. In an embodiment, the leg separator 108 can have a height equal to the raised back 204 of the backed ring 102. In alternate embodiments, the leg separator 108 can have a greater or lesser height than the raised back 204 of the backed ring 102. The raised back 204 of the backed ring can have a height sufficient to provide minor lumbar support to a child using the combination toilet trainer such that the child naturally centers on the inner opening of the combination toilet trainer, such that waste is deposited into the internal bowl and not left on the removable seat.

The base 101 can have a dispenser opening 201 that can be located on the back of the base 101. The dispenser opening 201 can be accessible by opening a dispenser cap 202 that can be attached to the dispenser opening 201 by a dispenser cap connector. In an embodiment, a user of the combination toilet trainer can use the dispenser opening 201 to dispense wipes, paper towels, toilet paper, or disposable liners for use in lining the internal bowl.

Figure 3:
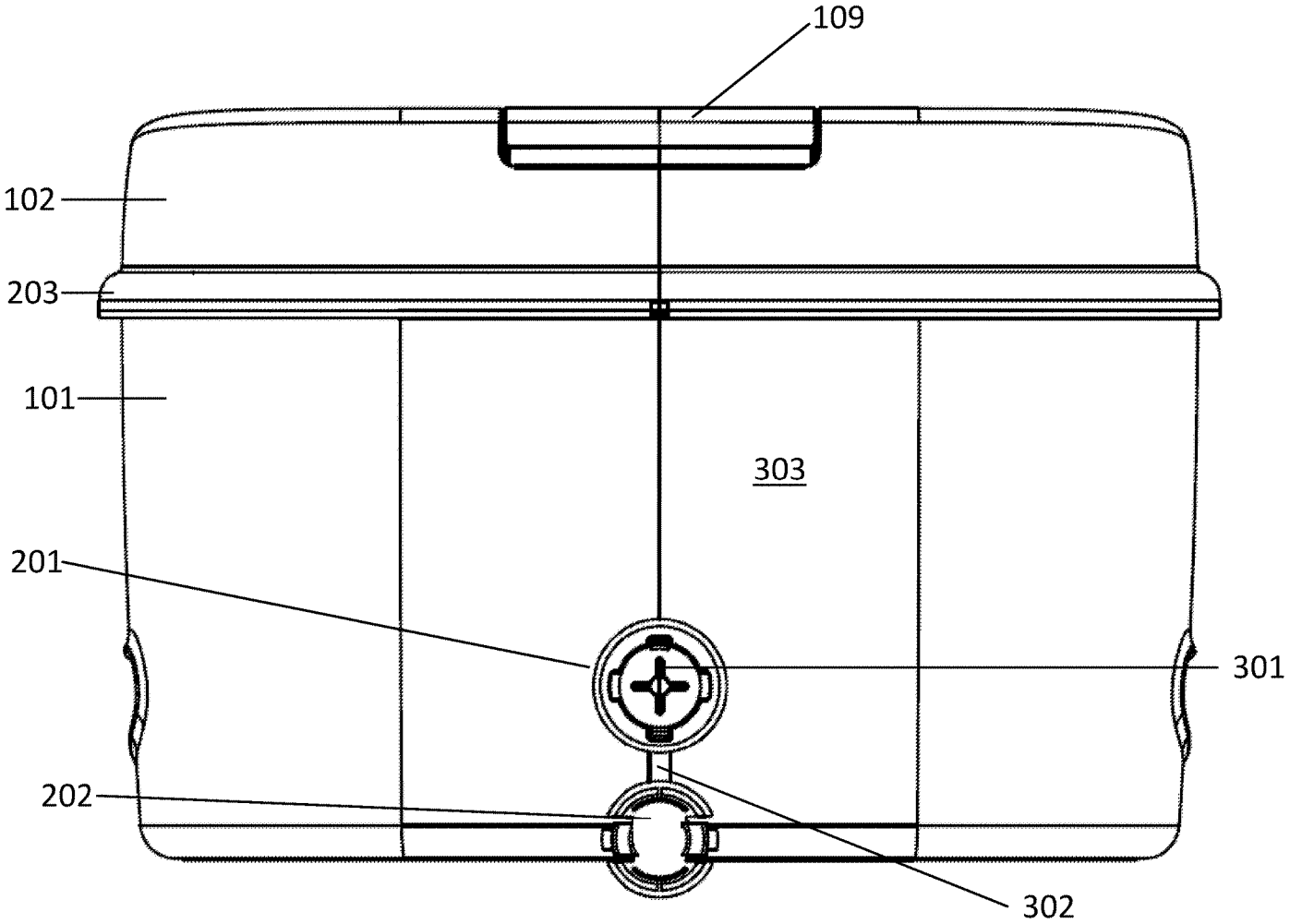
FIG. 3 illustrates a rear view of a combination toilet trainer, in accordance with embodiments described herein.

FIG. 3 illustrates a rear view of a combination toilet trainer, in accordance with embodiments described herein. As described above, the base 101 can have a dispenser opening 201 located on the backside 303 of the base 101 that can be configured to dispense a variety of products. In an embodiment, the material to be dispensed can be disposable liners for use in lining the internal bowl. The dispenser opening 201 can have one or more flexible tabs 301 that can be used as an anchor to secure the next piece of material to be dispensed such that a protruding piece of material is outside the dispenser opening 201 for manual removal. The dispenser cap 202 can cover the dispenser opening 201 when not in use, and can be attached to the dispenser opening 202 through a dispenser cap connector 302, which can be made of plastic or other flexible material.

In an embodiment, the hinge point 109 connecting the backed ring 102 with the hinged ring can be an open hinge, such that the hinged ring can be hinged open on the back component 102, but can also be removed for easy cleaning. As described above, the backed ring 102 can have a lipped portion 203 that overlaps with the base 101 such that the removable seat can fit securely on the base 101 when loaded.

Figure 4:
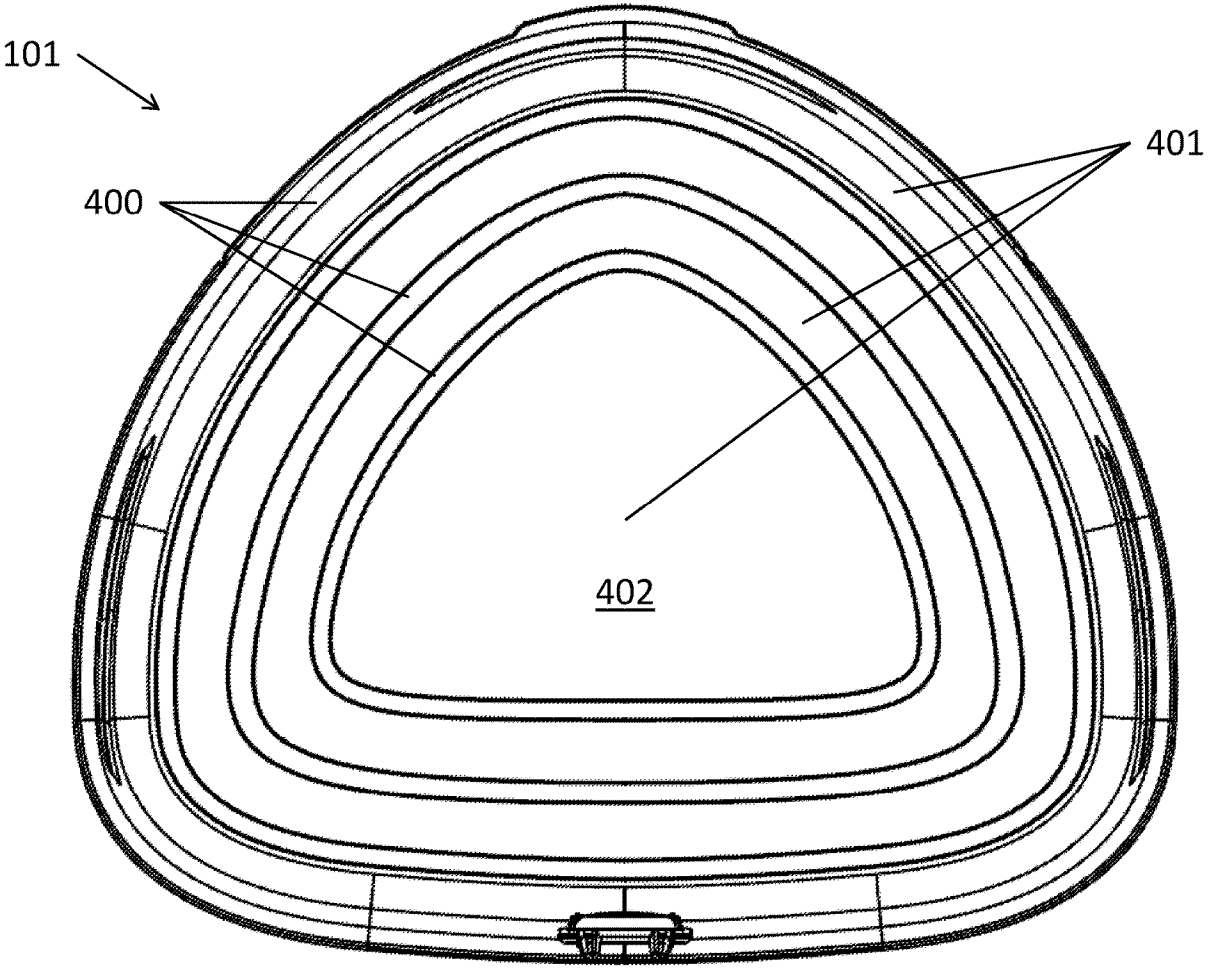
FIG. 4 illustrates a bottom view of a combination toilet trainer, in accordance with embodiments described herein.

FIG. 4 illustrates a bottom view of a combination toilet trainer, in accordance with embodiments described herein. In an embodiment, the base 101, once the removable seat has been removed, can be used as a step stool for a child to reach an adult toilet. In order to provide stability to the child when the child is standing on the base 101, one or more layers of rough material 401 can be alternated with one or more layers of non-slip material 400 such that the child's feet can remain firmly planted on the underside 402 of the base 101 and not slip off as the child climbs onto the adult toilet. Additionally, the one or more layers of non-slip material 400 can act as an anchor when the combination toilet trainer is being used as a training toilet, such that the non-slip material 400 can prevent the base 101 from moving on the floor when the child is using the combination toilet trainer. In an embodiment, the non-slip material 400 can be thermoplastic rubber, rubber, silicon, or other non-slip materials. In another embodiment, one or more layers of rough material 401 can be provided on the underside 402 of the base 101. In another embodiment, one or more layers of non-slip material 400 may be provided on the underside 402 of the base 101.

Figure 5:
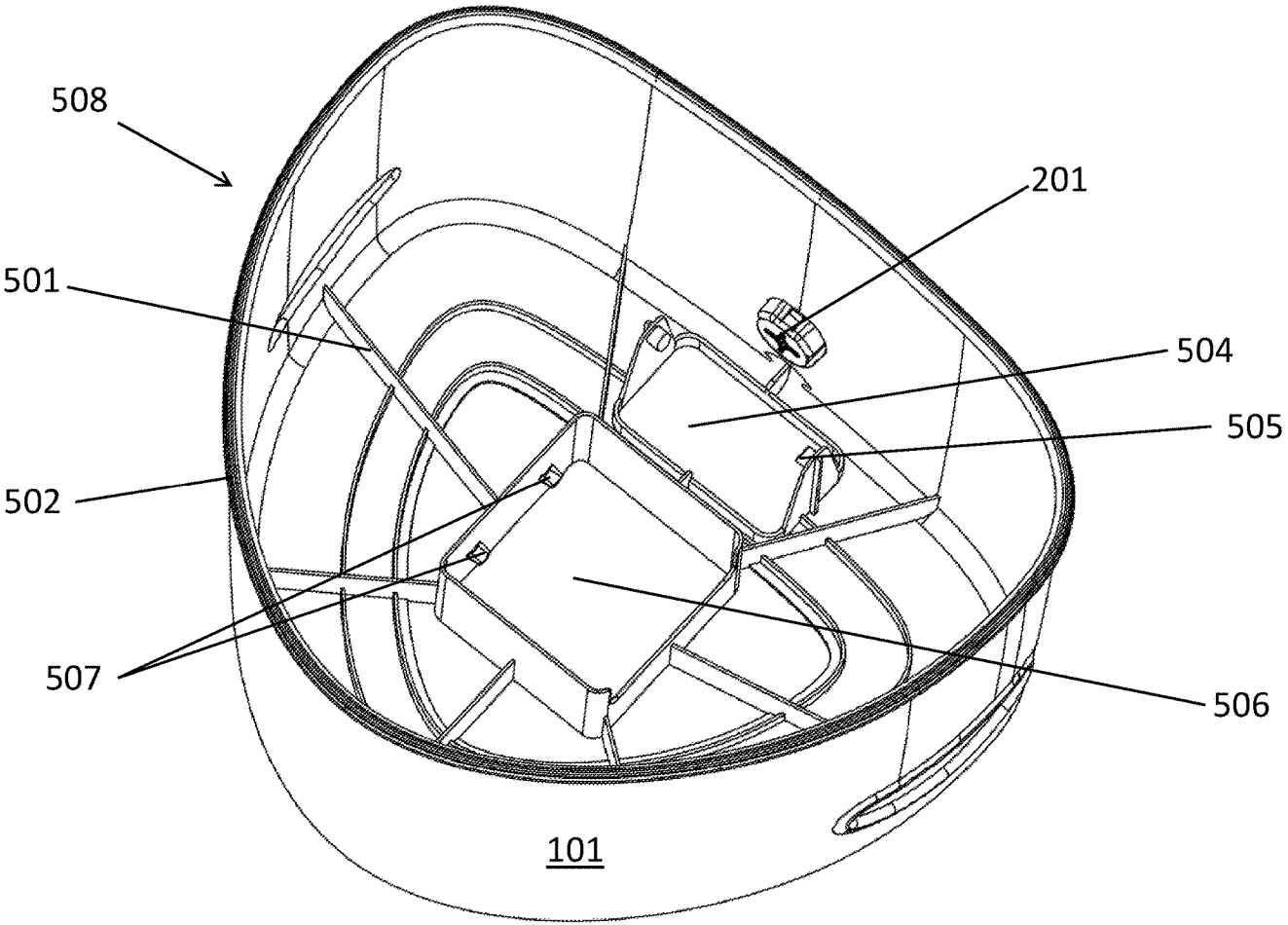
FIG. 5 illustrates a perspective view of a combination toilet trainer base, in accordance with embodiments described herein.
Figure 6:
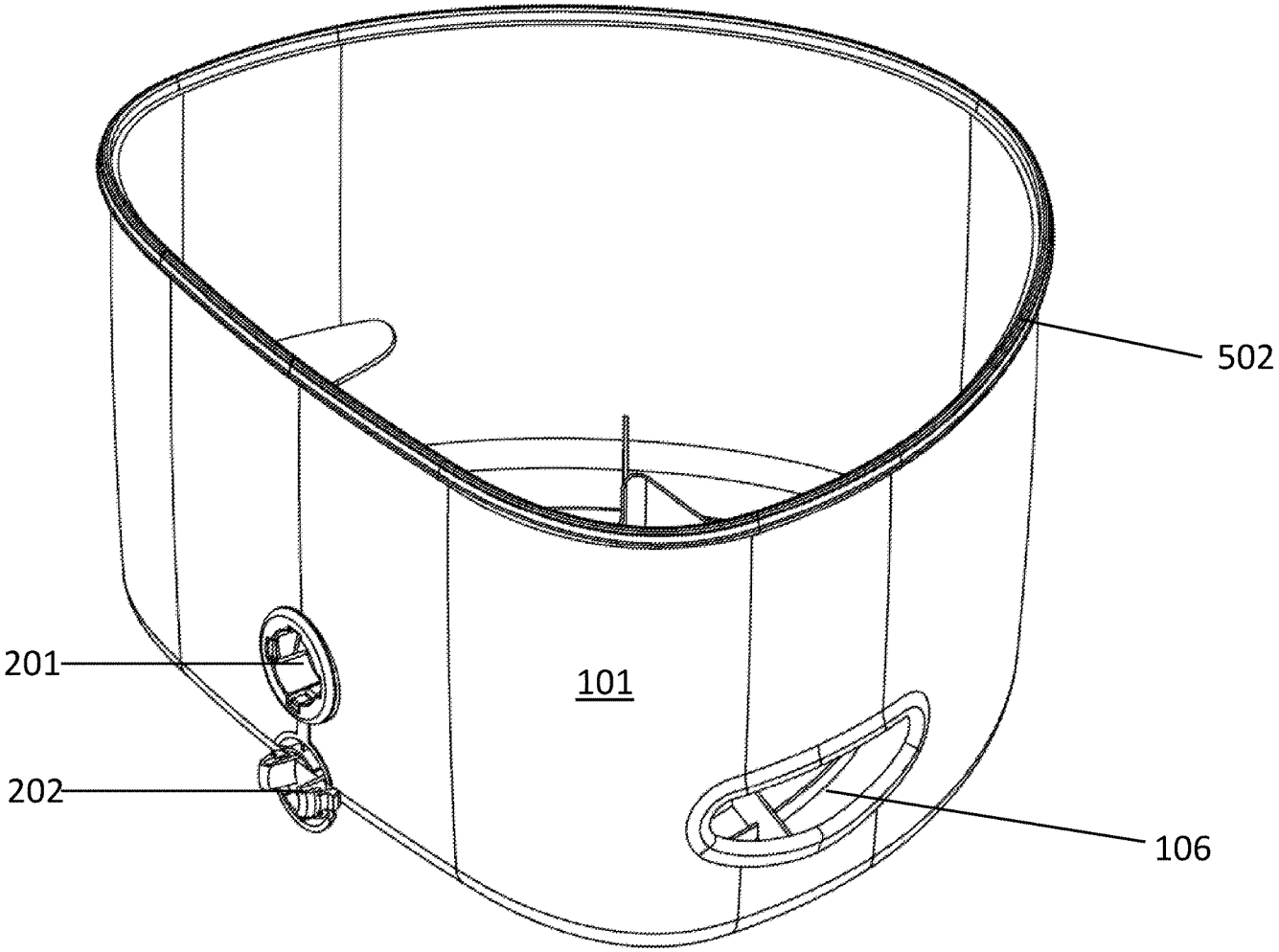
FIG. 6 illustrates a perspective view of a combination toilet trainer base, in accordance with embodiments described herein.

FIGS. 5 and 6 illustrate perspective views showing the inside of a combination toilet trainer base, in accordance with embodiments described herein. The base 101 can have one or more support struts 501 that can provide structural reinforcement to support the weight of a child standing on the base 101 when using it as a step stool. Additionally, the base 101 can have a strip of non-slip material 502 secured around the circumference of the rim of the base 101 on the base open side 508 such that the base 101 does not move on the floor when being used as a step stool. The strip of non-slip material 502 also can serve as a seal when the removable seat 107 is attached to the base 101 when the apparatus is being used as a toilet. The base can have a dispenser 504, which can be configured to dispense material from the inside of the base 101 to the outside through the dispenser opening 201, which can be closed using the dispenser cap 202. One or more tabbed tongs 505 can be used to secure a roll of dispensed material to the dispenser for ease of use. In an embodiment, the roll of dispensed material can be a roll of disposable liners for use with the internal bowl. A dispenser material holding area 506 can be used to hold one or more additional rolls of dispensed material in reserve. The dispenser material holding area 506 can have one or more holding area tabs 507 to secure rolls of dispensed material within the base 101. Handles 106 cut into the base can allow the base to be lifted and moved.

Figure 7:
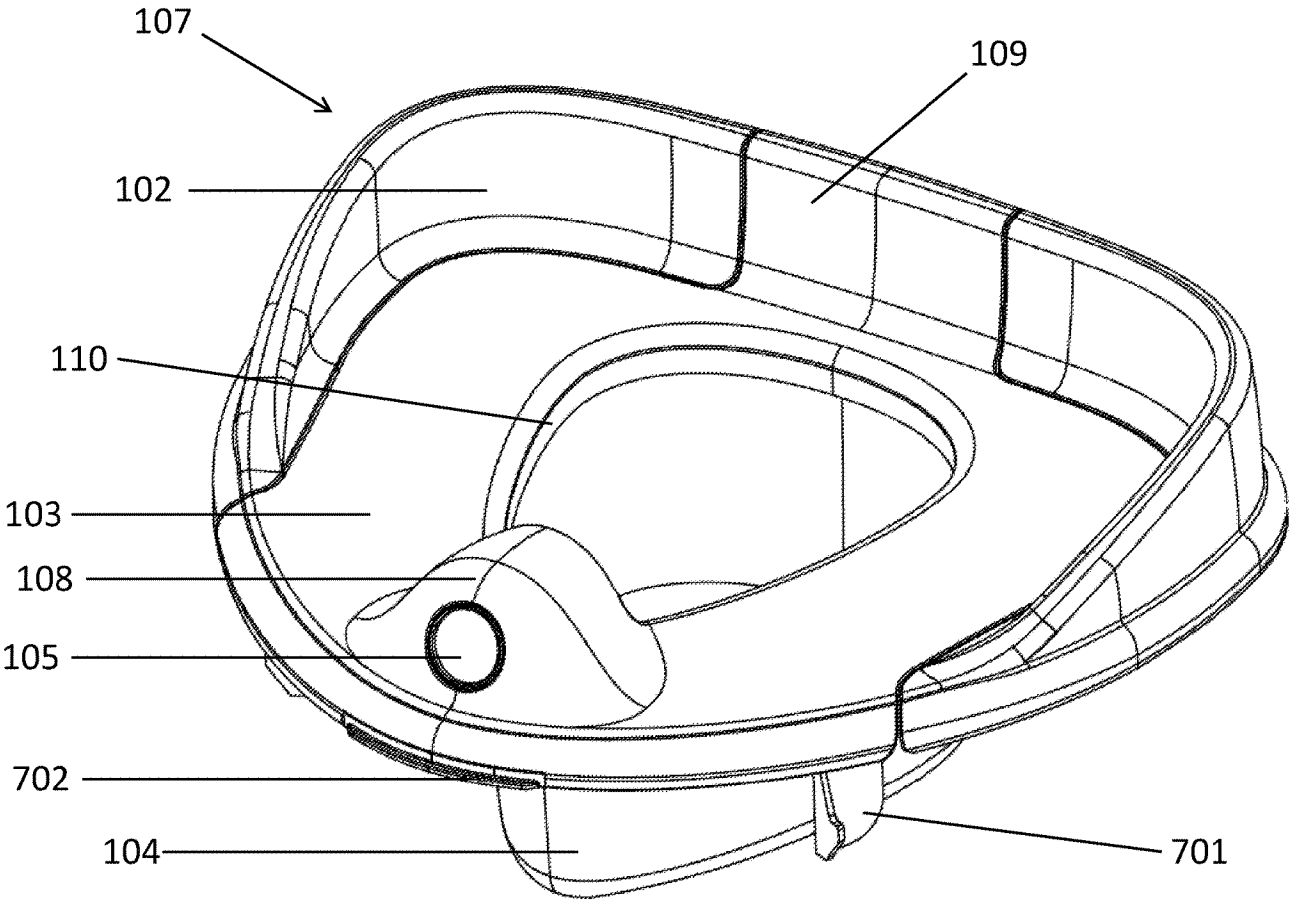
FIG. 7 illustrates a perspective view of a combination toilet trainer removable seat, in accordance with embodiments described herein.

FIG. 7 illustrates a perspective view of a combination toilet trainer removable seat, in accordance with embodiments described herein. In addition to the features previously mentioned, the removable seat 107 can have one or more toilet attachment hooks 701 that can be used to secure the removable seat to an adult toilet. In an embodiment, the removable seat 107 can be attached to the adult toilet through attachment to the adult toilet's bowl, or to the ringed portion of the adult toilet seat. The toilet attachment hooks can be placed in such a manner that the removable seat 107, when attached to the adult toilet, does not shift or move when the child sits on the removable seat 107, preventing slips and injuries. The removable seat 107 can be attached to an adult toilet using the toilet attachment hooks 701 with or without the internal bowl 104 attached. The hinged ring 103 can be opened against the backed ring 102 through the aid of the hinged point 109, as well as a gripping lip 702 that can be used to provide hand leverage. The hinged ring 103 can be secured in place using a depressible button 105, which can lock the leg separator 108 into place, securing the hinged ring 103.

Figure 8:
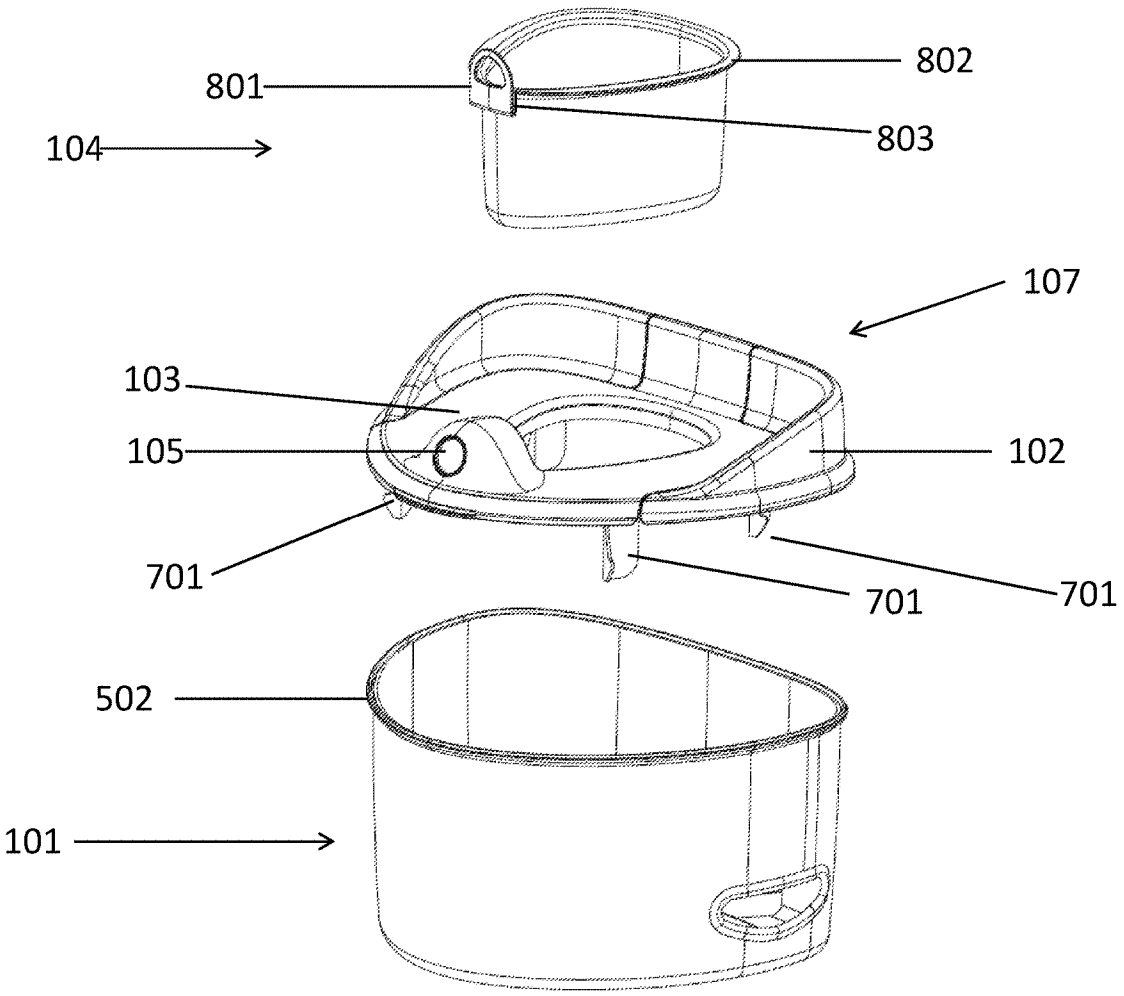
FIG. 8 illustrates an exploded view of the components of a combination toilet trainer, in accordance with embodiments described herein.

FIG. 8 illustrates an exploded view of the components of a combination toilet trainer, in accordance with embodiments described herein. The combination toilet trainer can have three main components: an internal bowl 104 designed to collect waste, a removable seat 107, and a base 101. The base 101 can also act as a step stool for a child. In various embodiments, the internal bowl 104 can be scented or unscented, and/or can possess anti-microbial or antiseptic properties. The internal bowl 104 can be lined before use. The liner can be secured to the internal bowl 104 with the aid of a bowl lip 802 that can be sandwiched between the backed ring 102 and the hinged ring 103 of the removable seat 107 when closed. A finger ring 801 can be attached the front of the internal bowl 104 to allow a user easy leverage by which to lift the internal bowl 104 of the combination toilet trainer for cleaning and/or replacing of the liner. The finger ring 801 can have finger ring curve 803 such that a liner can be secured into the curve 803 when the hinged ring flange (shown in FIG. 9) compacts the liner into the curve 803 when the hinged ring 103 is secured to the backed ring 102.

The removable seat 107 can have one or more toilet attachment hooks 701 for use in attaching the removable seat 107 to an adult toilet, which can be connected to the underside of the backed ring 102. The removable seat 107 can be secured to the base 101 and sealed using the strip of non-slip material 502 that rings the base 101. In an alternate embodiment, the underside of the backed ring 102 can also contain one or more strips of sealant material, such as foamed padding, which can be used to seal the removable seat 107 against the base 101 or adult toilet, whichever it is attached to.

Figure 9:
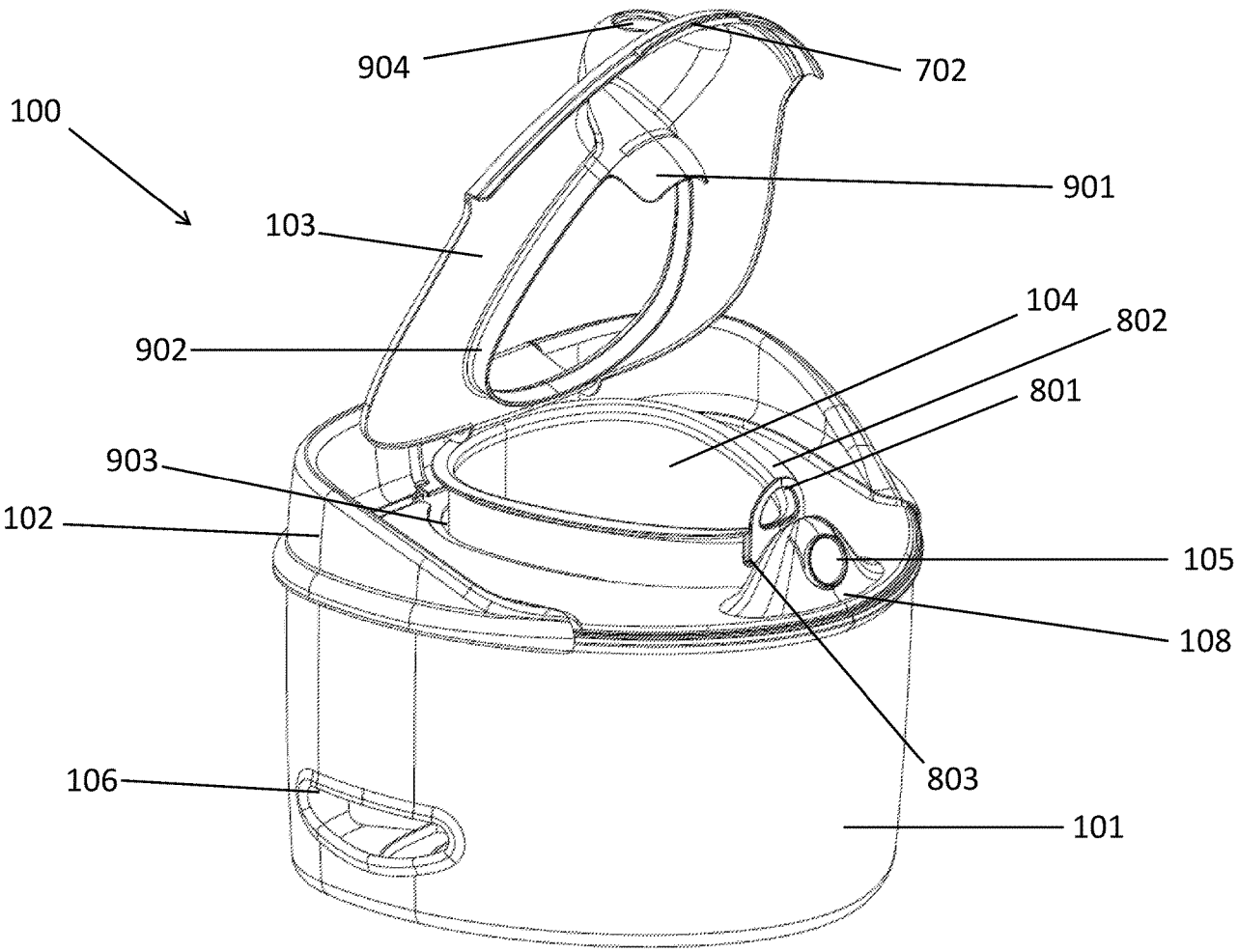
FIG. 9 illustrates a perspective view of a combination toilet trainer with the hinged ring lifted, in accordance with embodiments described herein.
Figure 10:
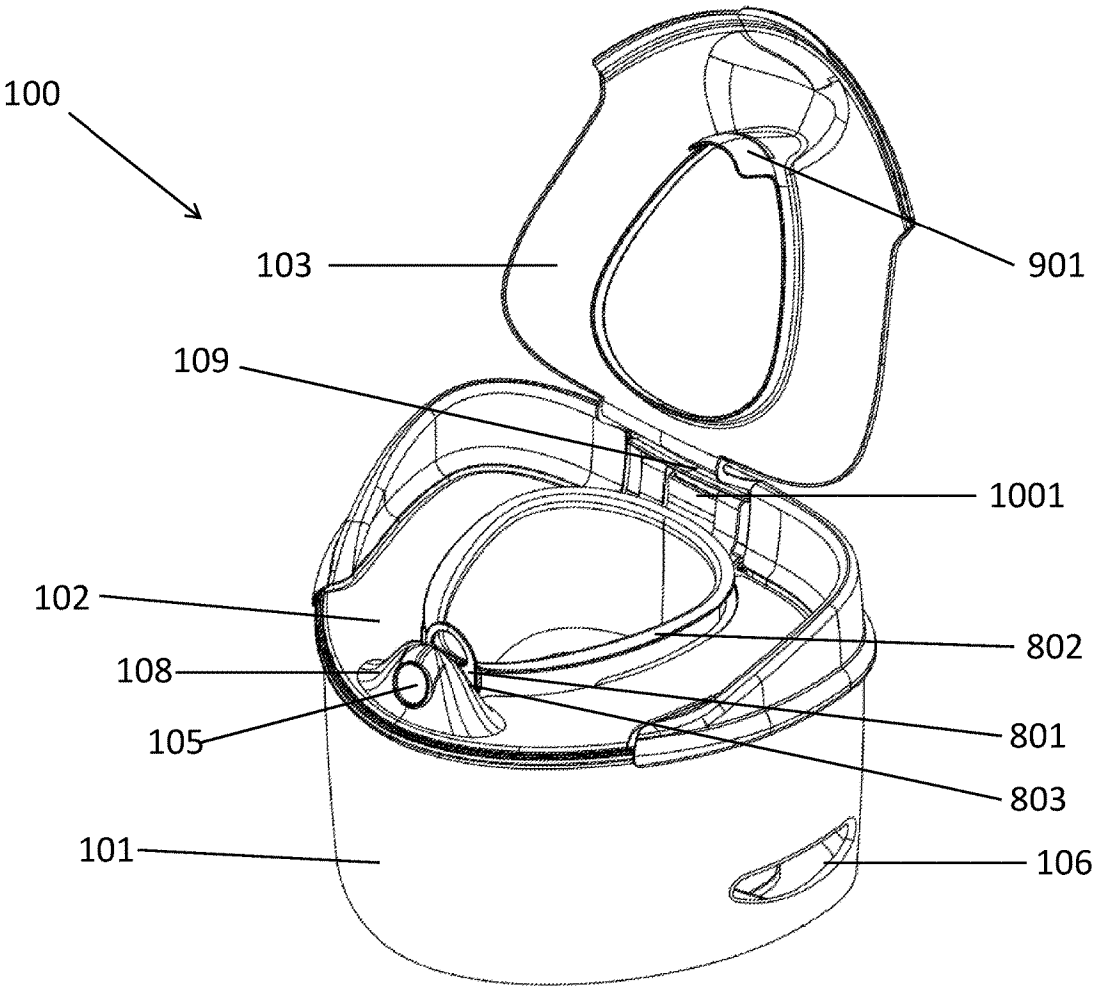
FIG. 10 illustrates a perspective view of a combination toilet trainer with the hinged ring lifted, in accordance with embodiments described herein.

FIGS. 9 and 10 illustrate perspective views of a combination toilet trainer with the hinged ring lifted, in accordance with embodiments described herein. In an embodiment, the combination toilet trainer 100 can be assembled in the following manner: the base 101 can be placed on the ground or floor. The backed ring 102 of the removable seat 107 can be secured to the base 101. The internal bowl 104, which can either be lined or unlined with a layer of liner material, can be inserted into the backed ring opening 102 such that the internal bowl lip 802 rests against the backed ring 102. The hinged ring 103 can then be attached to the backed ring 102 at the hinge point 109 and hinged down until the button 105 located on the leg separator 108 engages through the button opening 904 located on the hinged ring 103. The flange 901, which can extended downward from the hinged ring 103, can secure the liner material into the curve 803 of the finger ring 801 located on the internal bowl 104. The assembled combination toilet trainer 100 can be carried to a desired location using the handles 106 disposed on the side of the base 101.

To convert the assembled combination toilet trainer 100 into a removable seat 107 and a step stool, the combination toilet trainer 100 can be disassembled in the following manner: the hinged ring 103 can be opened through the use of the hinged ring lip 702, which can be pulled to hinge the hinged ring 103 upwards at a point of rotation centered at the hinge point 109. If desired, the hinged ring 103 can be detached from the backed ring 102. In an embodiment, a spring piece 1001 can be placed within the hinge point 109 to provide an outward spring force that facilitates the opening of the hinged ring 103 against the backed ring 102, and can additionally provide a spring force under the internal bowl lip 802 such that the internal bowl is lifted upwards when the hinged ring 103 is opened. The spring piece 1001 can be a spring or a piece of resistant material, including thermoplastic rubber, plastic, or metal. The internal bowl 104 can be lifted out of the backed ring 102 by finger pressure applied to the internal bowl ring 801. If the internal bowl 104 contains waste, the lining material (if present) can be disposed of and/or the internal bowl 104 can be cleaned. The backed ring 102 can then be disconnected from the base by applying opposing force to the backed ring 102 and the base 101. Once separated, the base can be rotated 180 degrees on any single axis and placed on the ground to act as a step stool. The backed ring 102 (with or without the hinged ring 103 attached) can be secured to an open adult toilet by placing the backed ring 102 atop the open adult toilet and applying pressure on the backed ring 102 towards the ground until the toilet attachment hooks engage. If the hinged ring 103 is not attached, the hinged ring 103 can then be attached to the backed ring 102 and closed by hinging downward on the hinge point 109. To remove the removable seat 107 from the adult toilet, upwards pressure can be applied until the toilet attachment hooks disengage.

The various components of the combination toilet training seat and step stool 100 may be made from any suitable plastic and/or rubber material. In an embodiment, many of the components of the combination toilet trainer 100 can be made with a thermoplastic rubber and/or an antimicrobial plastic material. Although the present invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

We claim:

1. A base comprising two handles, an underside, a backside, and an open side;

a removable seat comprising a backed ring and a hinged ring connected by a hinge point, each having an inner opening; and an internal bowl having an internal bowl lip;

wherein the removable seat is configured to be removably mounted atop the open side of the base; and wherein the internal bowl is configured to be removably attachable to the removable seat at the inner opening by the internal bowl lip being secured between the backed ring and the hinged ring, wherein the internal bowl further comprises a finger ring and a finger ring curve located on a front of the internal bowl;

the hinged ring further comprising a flange located on an underside of the hinged ring;

wherein the flange is configured to fit within the finger ring curve when the internal bowl is secured between the backed ring and the hinged ring.

2. The combination toilet trainer as recited in claim 1, wherein the underside of the base further comprises one or more layers of non-slip material alternated with one or more layers of rough material; and the open side of the base further comprises a strip of non-slip material secured around a circumference of the open side.

3. The combination toilet trainer as recited in claim 1, wherein the base further comprises a dispenser opening located on the backside of the base;

the dispenser opening further comprising one or more flexible tabs.

4. The combination toilet trainer as recited in claim 3, wherein the dispenser opening is configured to be closed using a dispenser cap attached to the dispenser opening through a dispenser cap connector.

5. The combination toilet trainer as recited in claim 3, wherein the base further comprises a dispenser configured to dispense a dispensed material from an inside of the base to an outside through the dispenser opening.

6. The combination toilet trainer as recited in claim 5, wherein the dispenser further comprises one or more tabbed tongs configured to secure a roll of dispensed material.

7. The combination toilet trainer as recited in claim 5, wherein the base further comprises a dispenser material holding area configured to hold one or more rolls of dispensed material.

8. The combination toilet trainer as recited in claim 7, wherein the dispenser material holding area further comprises one or more holding area tabs configured to secure the one or more rolls of dispensed material.

9. The combination toilet trainer as recited in claim 1, wherein the internal bowl is scented.

10. The combination toilet trainer as recited in claim 1, wherein the removable seat further comprises one or more toilet attachment hooks located on an underside of the backed ring, the toilet attachment hooks configured to attach the removable seat to an adult toilet when detached from the base.

11. The combination toilet trainer as recited in claim 1, wherein the removable seat further comprises one or more strips of sealant material secured to an underside of the backed ring.

12. The combination toilet trainer as recited in claim 1, further comprising a spring piece placed within the hinge point configured to provide an outward spring force against an underside of the internal bowl lip when the hinged ring is hinged open from the backed ring.

13. A removable seat for use in toilet training, comprising:

a backed ring and a hinged ring connected by a hinge point, each having an inner opening; and an internal bowl having an internal bowl lip;

wherein the internal bowl is configured to be removably attachable to the removable seat at the inner opening by the internal bowl lip being secured between the backed ring and the hinged ring, wherein the internal bowl further comprises a finger ring and a finger ring curve located on a front of the internal bowl;

the hinged ring further comprising a flange located on an underside of the hinged ring;

wherein the flange is configured to fit within the finger ring curve when the internal bowl is secured between the backed ring and the hinged ring.

14. The removable seat as recited in claim 13, wherein the removable seat further comprises one or more toilet attachment hooks located on an underside of the backed ring, the toilet attachment hooks configured to attach the removable seat to an adult toilet.

15. The removable seat as recited in claim 13, further comprising:

a base comprising two handles, an underside, a backside, and an open side;

wherein the removable seat is configured to be removably mounted atop the open side of the base.

16. The removable seat as recited in claim 15, wherein the underside of the base further comprises one or more layers of non-slip material alternated with one or more layers of rough material; and the open side of the base further comprises a strip of non-slip material secured around a circumference of the open side.

17. The removable seat as recited in claim 15, wherein the base further comprises a dispenser configured to dispense a dispensed material from an inside of the base to an outside through a dispenser opening.

18. A combination toilet trainer, comprising:

a base comprising two handles, an underside, a backside, and an open side;

a removable seat comprising a backed ring and a hinged ring connected by a hinge point, each having an inner opening; and an internal bowl having an internal bowl lip;

wherein the removable seat is configured to be removably mounted atop the open side of the base; and wherein the internal bowl is configured to be removably attachable to the removable seat at the inner opening by the internal bowl lip being secured between the backed ring and the hinged ring, further comprising a spring piece placed within the hinge point configured to provide an outward spring force against an underside of the internal bowl lip when the hinged ring is hinged open from the backed ring.

* * * * *